US009486684B2

(12) United States Patent
Howerton

(10) Patent No.: US 9,486,684 B2
(45) Date of Patent: Nov. 8, 2016

(54) BATTING TRAINING DEVICE AND METHODS

(71) Applicant: Charles S. Howerton, Ventura, CA (US)

(72) Inventor: Charles S. Howerton, Ventura, CA (US)

( * ) Notice: Subject to any disclaimer, the term of this patent is extended or adjusted under 35 U.S.C. 154(b) by 120 days.

(21) Appl. No.: 14/607,870

(22) Filed: Jan. 28, 2015

(65) Prior Publication Data

US 2016/0213991 A1 Jul. 28, 2016

(51) Int. Cl.
*A63B 69/00* (2006.01)

(52) U.S. Cl.
CPC ..... *A63B 69/0002* (2013.01); *A63B 69/0075* (2013.01); *A63B 2069/0008* (2013.01); *A63B 2225/093* (2013.01)

(58) Field of Classification Search
CPC ..... A63B 69/00
USPC ..... 473/417, 431, 454, 451
See application file for complete search history.

(56) References Cited

U.S. PATENT DOCUMENTS 4,709,924 A * 12/1987 Wilson ..... A63B 69/0075 473/417
5,388,823 A * 2/1995 Prieto ..... A63B 69/0075 473/417
5,556,091 A * 9/1996 Lin ..... A63B 69/0075 473/417
5,928,092 A * 7/1999 Keeter ..... A63B 69/0075 473/417
7,131,916 B2 11/2006 Griffin
7,465,243 B2 12/2008 Cramer
7,662,052 B1 2/2010 Vidrine
7,967,704 B2 6/2011 Schulte
8,147,357 B1 4/2012 Nichols
8,187,124 B2 5/2012 Ciesar et al.
2005/0101418 A1* 5/2005 Cech ..... A63B 69/0002 473/417
2008/0085787 A1* 4/2008 Molloy ..... A63B 69/0002 473/417
2009/0029803 A1* 1/2009 Lincoln ..... A63B 69/0075 473/417
2010/0248853 A1 9/2010 Dellinger
2010/0311524 A1 12/2010 Lay
2011/0077109 A1 3/2011 Crowley
2011/0136593 A1* 6/2011 Keller ..... A63B 63/003 473/417
2011/0224027 A1 9/2011 Edmondson
2012/0165138 A1 6/2012 Smith
2012/0220395 A1* 8/2012 Lay ..... A63B 69/0075 473/451
2012/0295727 A1 11/2012 Smed
2014/0256475 A1 9/2014 Hymer

* cited by examiner

*Primary Examiner* — Gene Kim
*Assistant Examiner* — M Chambers
(74) *Attorney, Agent, or Firm* — Thomas J. Oppold; Larkin Hoffman Daly & Lindgren, Ltd.

(57) ABSTRACT

A batting training device having a track defining a track path extending to each side of a batter's strike zone. The path may be arcuate. A trolley supporting a vertically adjustable post is movable along the path. The vertically adjustable post is movable between a lower end of the batter's strike zone and an upper end of the batter's strike zone, wherein the trolley movable along the path and the vertically adjustable post cooperate such that the ball is capable of being positioned substantially anywhere in a batter's strike zone for batting training.

5 Claims, 3 Drawing Sheets

BATTING TRAINING DEVICE AND METHODS

BACKGROUND

Developing proper batting technique is essential for baseball and softball players. A good swing requires considerable coordination and precise positioning of the batter's legs, torso, and arms during the swing which vary depending on the position of the ball when entering the strike zone. A need exists for a device that enables the batter to practice his or her swing with the correct body movements when swinging at different pitches in the strike zone, e.g., low and away, high and inside, etc.

To develop such skills, a batter must practice repeatedly hitting balls in these various positions so the batter can learn the correct body movement for each pitch. It is difficult for any pitcher to consistently throw the ball in certain areas of the strike zone to allow a batter to practice repeatedly swing at a particular pitch. While automatic pitching machines may be set up to consistently pitch the ball into different areas of the strike zone, the availability of such machines and the ability to set up the machines to consistently pitch balls into different areas of the strike zone are generally available only to professional and college players. Accordingly, there is a need for a device that allows a ball to be positioned in a particular location within the strike zone consistently, so the batter can practice repeatedly hitting the ball in that position to develop the proper body motion for hitting the ball in that location and so a batting coach can observe the batter as he or she swings at the ball to offer suggestions to improve the batter's technique and body motion during the swing.

Additionally, a batter needs to develop timing and body movements in order to effectively hit different pitches. For example if the ball is pitched toward the inside of the strike zone (an "inside pitch"), the batter needs to learn timing to get the bat in front of the plate as the ball enters the strike zone. Alternatively, if the ball is pitched toward the outside of the strike zone (an "outside pitch"), the batter needs to learn timing and body movement to hit the ball further back or rearward of the front to the plate. Accordingly, there is a need for a device that allows the ball position to be quickly and easily positioned toward the front of the plate when practicing for hitting inside pitches and rearward of the front of the plate when practicing for hitting outside pitches.

DESCRIPTION

Figures 1, 2:
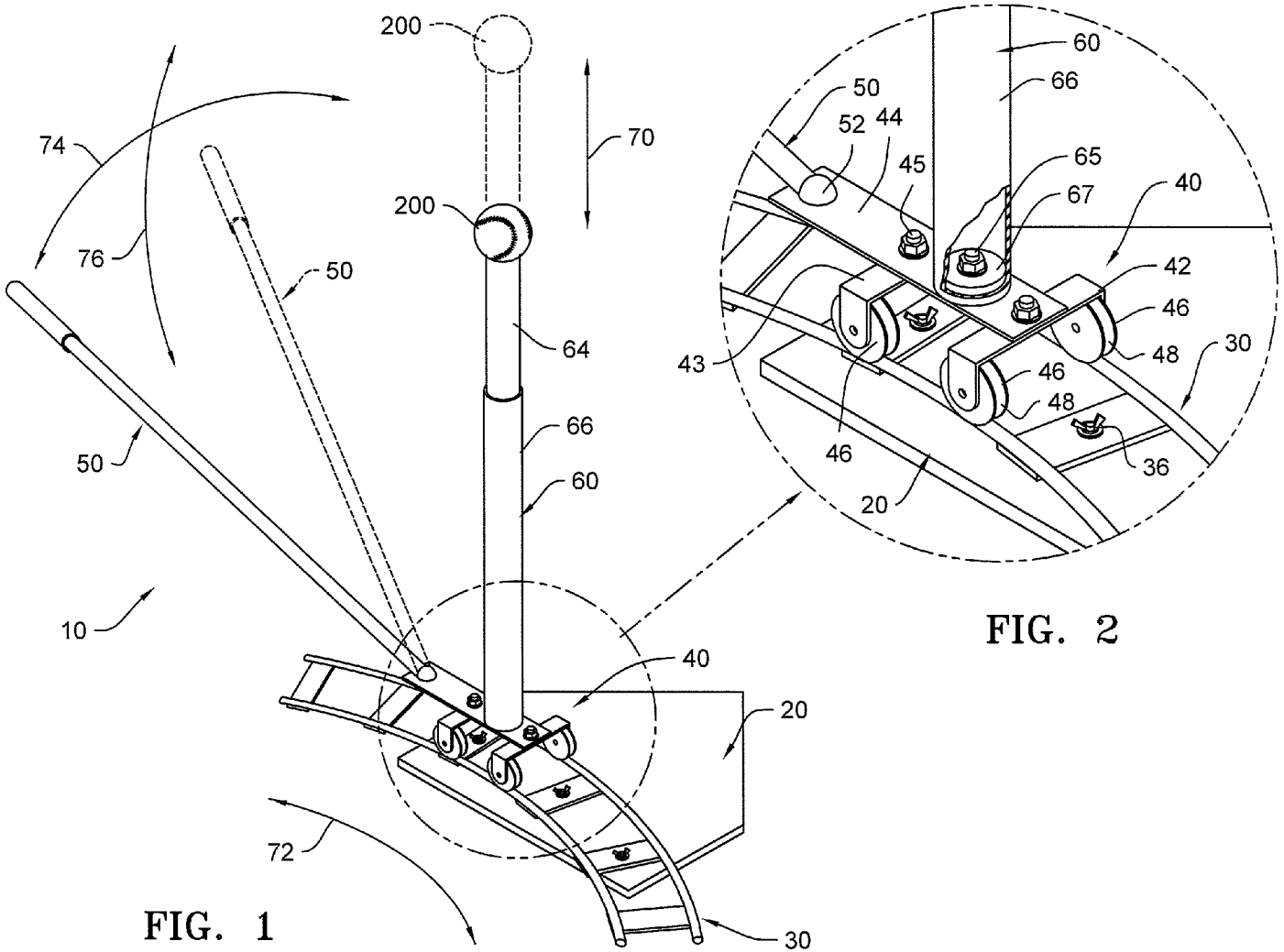
FIG. 1 is a perspective view of one embodiment of a batting training device.
FIG. 2. is an enlarged view of the trolley and track circled in FIG. 1.

Referring to the drawings, wherein like reference numerals designate identical or corresponding parts throughout the several views, FIG. 1 is a perspective view of one embodiment of a batting training device 10, comprising a home plate 20, a track 30, a trolley 40, a handle 50 and a post 60.

The track 30 is comprised of a front rail 32 and a rear rail 34 fixedly spaced apart by rail spacers 36. The track 30 may be removably secured to the home plate 20 by any suitable means, such as by a wing nuts threaded onto threaded bolt extending through an aperture from the underside of the home plate 20 through an aligned aperture in the rail spacers 36 as shown in FIG. 2. The track 30 may be substantially straight forming a linear path extending from side-to-side of the strike zone or the track 30 may be an arcuate track with a radius of curvature defining an arcuate path extending from side-to-side of the strike zone and extending forwardly of a forward edge of the plate and curving rearwardly. In the arcuate track embodiment, the track 30 may be removable and rotatable with respect to the home plate 20 for orienting the arcuate track for both right handed and left handed batters.

The rails 32, 34 may be made of steel rods that are linear for the linear track or curved to the appropriate radius of curvature for the arcuate track. The rods may be welded to steel plates comprising rail spacers 36 to form the rigid track 30, however, it should be appreciated that the rails and rail spacers may be made of any suitable and durable material capable of being secured together to form a rigid track.

The trolley 40 is comprised of two pairs of wheel assemblies 42, 43 secured in spaced relation to a top plate 44. In embodiments with the arcuate track, the wheels assemblies 42, 43 are secured to the top plate 44 by pivot connections 45 so that the wheel assemblies can be pivoted with respect to the top plate 44 when changing the configuration of the device 10 for left and right handed batters (discussed below). The pivot connections 45 may be a simple bolted connection as shown in FIG. 2 or other suitable pivotable connection. Each wheel assembly 42, 43 is comprised of a pair of vertically oriented wheels 46 rotatably secured to a U-shaped bracket 47. The outer circumference of each wheel 46 includes a groove 48 sized to receive the rails 32, 34. Thus, the wheel grooves 48 and rails 32, 34 cooperate to maintain the trolley 40 on the track 30.

The handle 50 is pivotally and rotationally attached, such as by a ball joint connection 52, to an outwardly extending end of the top plate 44 as shown in the embodiment of FIG. 2.

The batting training device 10 as shown in FIGS. 1, 3A, 3B, 4A and 4B illustrates an arcuate track embodiment with the trolley 40 and handle 50 configured for a right hand batter. However, it should be appreciated that the device 10 is readily convertible for left handed batters. To convert the device from a right handed batter configuration to a left handed batter configuration, the track 30 may remain in place and the trolley 40 may be simply lifted from the track 30 and rotated 180 degrees such that the handle 50 is on the left side of the home plate 20 instead of the right side of the home plate 20. The wheel assemblies 42, 43 are pivoted about the pivot connections 45 with respect to the top plate so the wheels 46 again align with rails 32, 34 of the track 30.

The post 60 includes an upper end 62 sized to receive and support a baseball or softball 200. The post 60 is vertically adjustable to enable the height of the post 60 to be changed for positioning the ball vertically relative to the home plate 20 as indicated by arrow 70 in FIG. 1. The lower end of the post 60 is secured to the top plate 44 of the trolley by any suitable means. The post 60 may be removable from the trolley 40 in the event the post 60 is zdamaged during use. For example, the lower end of the post 60 may be secured to the top plate 44 of the trolley 40 by a bolted connection 65 as shown in the cutaway section of FIG. 2, wherein a threaded bolt extends through aligned apertures in the top plate 44 and in a bottom plate 67 at the lower end of the post 60 and retained by a washer and nut.

The vertically adjustable post 60 may be telescoping upper and lower post sections 64, 66. In one embodiment, the upper and lower post sections may be slightly obround so that when the desired height of the movable inner post section is reached, a slight twist or rotation of the upper post section 64 with respect to the lower post section 66 will lock the upper post section at the desired height relative to the lower post section 66. Alternatively, the post sections may incorporate vertically alignable apertures through which a pin may be inserted to pin the sections together at the desired height (not shown). Alternatively, the post sections may incorporate vertically alignable apertures that cooperate with a spring biased push button to lock the upper and lower post sections at the desired height (not shown). In yet another alternative embodiment, the upper and lower post sections may be coarsely threaded so that the upper post section is threadably adjustable with respect to the lower post section (not shown). In yet another alternative embodiment, the movement of the upper post section with respect to the lower post section may utilize a battery powered linear actuator which may be controlled utilizing a button or switch mounted at the end 54 of the handle 50 (not shown).

Figure 4A:
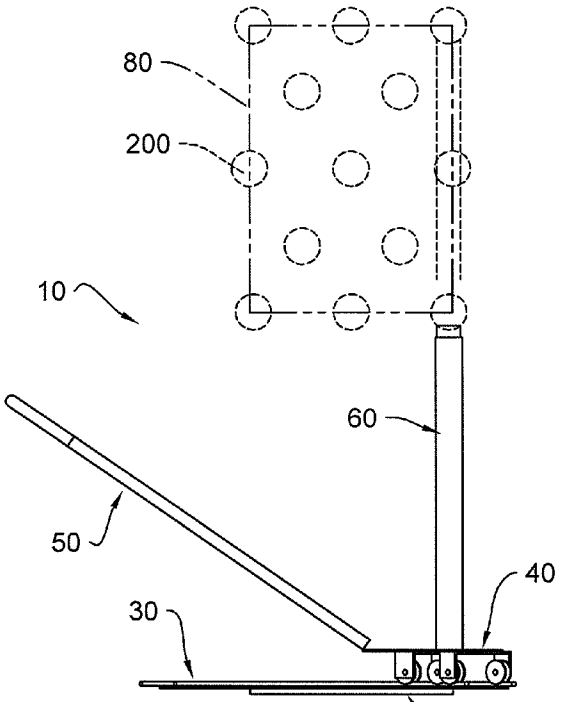
FIG. 4A is a top plan view of the batting training device of FIG. 1 with the trolley and ball positioned to the inside of the strike zone (for a right handed batter).
Figure 4B:
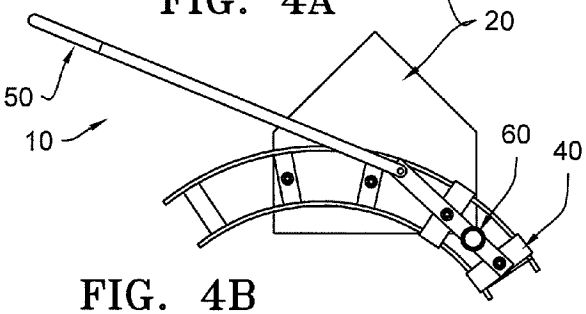
FIG. 4B is an elevation view of the batting training device of FIG. 4A showing the ball positioned at the low and inside position of the strike zone (for a right handed batter) and showing the post (in dashed lines) extended to position the ball at the high and inside position of the strike zone (for a right handed batter).
Figure 3A:
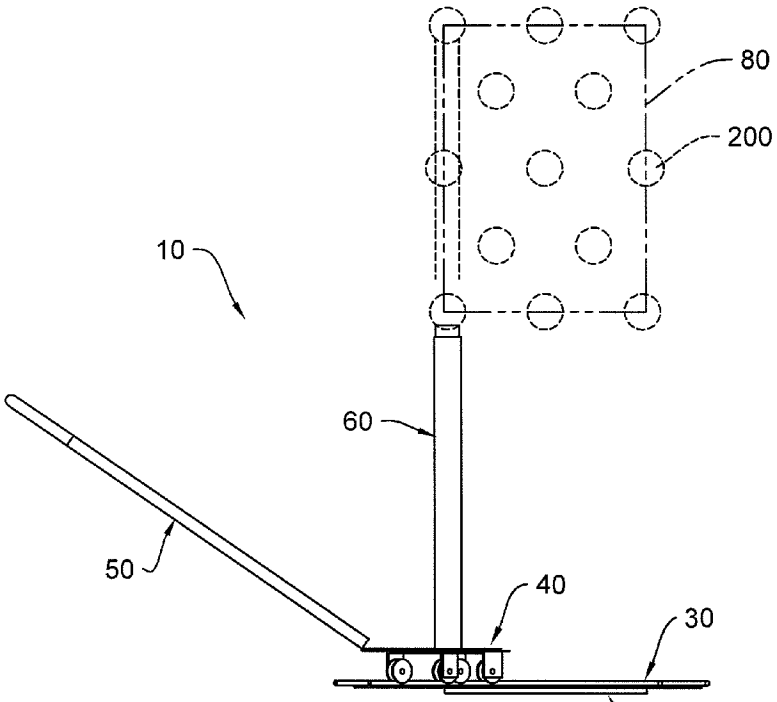
FIG. 3A is a top plan view of the batting training device of FIG. 1 with the trolley and ball positioned to the away outside of the strike zone (for a right handed batter).
Figure 3B:
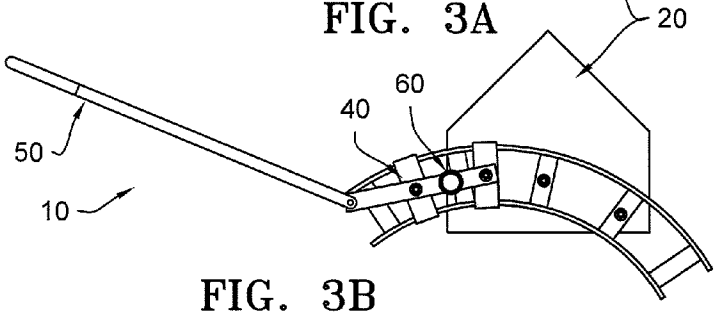
FIG. 3B is an elevation view of the batting training device of FIG. 3A showing the ball positioned at the low and away position of the strike zone (for a right handed batter) and showing the post (in dashed lines) extended to position the ball at the high and away position of the strike zone (for a right handed batter).

In use, a batting coach grasps the end 54 of the handle 50 to pull or push the trolley 40 side-to-side along the length of the track 30 as indicated by arrow 72 in FIG. 1. As the trolley 40 moves along the track 30, the ball joint 52 permits the end 54 of the handle 50 to freely move in any direction as indicated by arrows 74, 76. As illustrated in FIGS. 3A 3B, the trolley 40 is shown positioned away from the position of the right handed batter at the outermost side of the strike zone 80 indicated by the phantom line in FIG. 3B. As indicated by the dashed lines in FIG. 3B, the ball 200 may be positioned vertically within the strike zone 80 my moving the upper post section 64 up and down with respect to the lower post section 66. Referring to FIGS. 4A and 4B, the trolley 40 is shown positioned toward the position of the right handed batter at the innermost side of the strike zone 80 indicated by the phantom line in FIG. 4B. As indicated by the dashed lines in FIG. 4B, the ball 200 may be positioned vertically within the strike zone 80 my moving the upper post section 64 up and down with respect to the lower post section 66. Based on the foregoing, it should be appreciated that the ball 200 can be positioned side-to-side and vertically anywhere in the strike zone 80 as indicated in FIGS. 3B and 4B by moving the trolley 40 from side to side along the track 30 and vertically adjusting the height of the post 60.

Accordingly, it should be appreciated that the batting training device 10 allows a ball to be positioned in a particular location within the strike zone consistently, so the batter can practice repeatedly hitting the ball in that position to develop the proper body motion for hitting the ball in that location and so a batting coach can observe the batter as he or she swings at the ball to offer suggestions to improve the batter's technique and body motion during the swing.

In embodiments in which the track 30 defines an arcuate path that curves from a forward edge of the plate rearwardly such that the ball 200 is also capable of being positioned between a forward edge of the home plate 20 when practicing to hit inside pitches and rearward with respect to the forward edge of the home plate 20 when practicing to hit outside pitches. Accordingly, it should also be appreciated that the batting training device 10 allows the ball position to be quickly and easily positioned in a different areas of the strike zone and different distances from the front of the plate to enable the batter to develop the skills necessary to adjust his or her body movement from swing to swing to hit different pitches.

Figure 5:
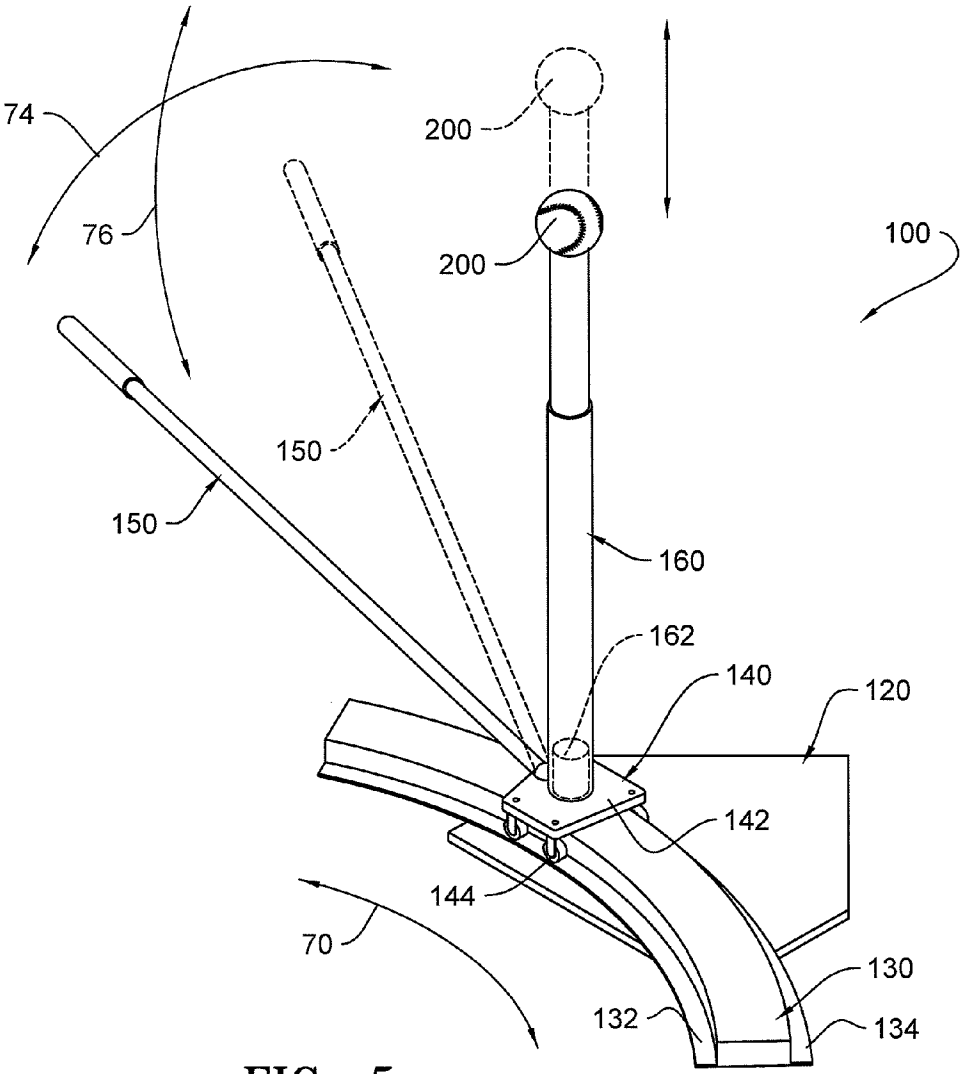
FIG. 5 is an alternative embodiment of the batting training device.

FIG. 5 illustrates an alternative embodiment of the batting training device 100, comprising a home plate 120, a track 130, a trolley 140, a handle 150 and a post 160.

In the embodiment of FIG. 5, the track 130 is fabricated as a single integral unit of durable, wear resistant material, such a molded plastic. As in the previous embodiment, the track 130 may be substantially straight forming a linear path extending from side-to-side of the strike zone or the track 130 may be an arcuate track with a radius of curvature defining an arcuate path extending from side-to-side of the strike zone and extending forwardly of a forward edge of the plate and curving rearwardly.

The track 130 includes a front rail 132 and a parallel rear rail 134 formed as flanges projecting from each side of a raised block 136. The track 130 may be removably secured to the home plate 120 by any suitable means, including, for example, downwardly extending pegs insertable into matingly aligned apertures formed in the surface of the home plate 120 (not shown). As with the previous embodiment, the track 130 may be removed and rotatable with respect to the home plate for training both left hand and right hand batters.

The trolley 140 has a body 142 fabricated as an integral unit of durable, wear resistant material, such as molded plastic. Rotatable wheels 144 are secured at each of the four corners with the two wheels on each side of the raised block 136 of the track 130, such that the raised block 136 of the track 130 cooperates to maintain the wheels 144 of the trolley 140 on the arcuate track 130. It should be appreciated that in the arcuate track embodiments, the body 142 of the trolley may be trapezoidal in shape with the wheels on the front rail 132 being spaced closer than the wheels on the rear rail 134 to account for the arcuate shape of the track 130.

The handle 150 is pivotally attached to the top side of the trolley 140 as in the previous embodiment. The post 160 is attached to the top side of the trolley 140 and may comprise any of the embodiments previously described. For attaching the post 160 to the trolley 140, a short stub 162 may be molded into the top surface of the trolley body 142 over which the post 160 is frictionally received or otherwise secured.

The use and advantages of the batting training device 100 is substantially the same as described above with respect to the other embodiment of the batting training device 10.

Various embodiments have been described above for purposes of illustrating the details thereof and to enable one of ordinary skill in the art to make and use the invention. The details and features of the disclosed embodiments are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A batting training device comprising:

a home plate defining sides of a strike zone;

a track defining a path extending from side-to side of the strike zone;

a trolley disposed on the track and moveable along the path;

a vertically adjustable post having a lower end secured to the trolley and an upper end sized to support a ball, the vertically adjustable post movably between a lower end of a batter's strike zone and an upper end of the batter's strike zone;

wherein the moveable trolley and the vertically adjustable post cooperate such that the ball is capable of being positioned substantially anywhere in the batter's strike zone and wherein the path is an arcuate path curving from a forward end of the home plate rearwardly such that the trolley is movable between a forward edge of the home plate for batting training on inside pitches and rearward with respect to the forward edge of the home plate for batting training on outside pitches.

2. The batting training device of claim 1 wherein the horizontal track is removably attachable to the home plate.

3. The batting training device of claim 1 wherein the horizontal track comprises an inner rail and a substantially parallel outer rail which together define the path.

4. The batting training device of claim 1 wherein the trolley includes wheels which role along the path.

5. The batting training device of claim 1 further comprising a handle pivotally attached to the trolley for positioning the trolley on the path.

* * * * *